United States Patent [19]

Tanaka et al.

[11] 4,348,616

[45] Sep. 7, 1982

[54] PRESET LIGHTING DEVICE

[75] Inventors: Kazuyuki Tanaka, Yamanashi; Yoshiharu Ueki, Kawagoe; Yoshiro Kunugi, Kawagoe; Shozaburo Sakaguchi, Kawagoe, all of Japan

[73] Assignee: Pioneer Electronic Corporation, Tokyo, Japan

[21] Appl. No.: 229,213

[22] Filed: Jan. 28, 1981

[30] Foreign Application Priority Data

Nov. 15, 1979 [JP] Japan ..... 54-158379

[51] Int. Cl.[3] ..... H05B 37/02

[52] U.S. Cl. ..... 315/314; 307/38; 315/201; 315/208; 315/315; 315/320

[58] Field of Search ..... 315/201, 208, 210, 293, 315/313, 314, 315, 317, 320, 322, 323, 362; 307/38, 115; 328/75

[56] References Cited

U.S. PATENT DOCUMENTS 3,778,676 12/1973 Keller ..... 315/323 X 4,105,928 8/1978 Leconte ..... 315/314 X

*Primary Examiner*—Eugene R. La Roche

*Attorney, Agent, or Firm*—Sughrue, Mion, Zinn, Macpeak and Seas

[57] ABSTRACT

A preset lighting device in which the number of common input and output terminals is reduced and which does not respond to a duplicate switch activation state so that a previously-determined lighting state as maintained until a valid activation state is present. A lighting element is provided for each of plural input switches which are in turn coupled to corresponding input/output terminals. A latch circuit is provided for each lighting element to maintain the lighted state until reset occurs. First and second gate circuits detect a duplicate switching state and control the activation of the lighting elements accordingly.

5 Claims, 4 Drawing Figures

PRESET LIGHTING DEVICE

BACKGROUND OF THE INVENTION

The present invention relates to a preset lighting device in which input and output terminals are adapted to be switchable.

Generally, preset lighting devices of this type have been provided with separate input and output terminals. Such preset lighting devices are, however, disadvantageous in that a great amount of space is needed for the attachment of the terminals, especially in the case the device is provided as an integrated circuit.

Microcomputer ICs often have input and output terminals common to each other for which input and output operations are performed on a time-shared basis by the application of appropriate clock pulses. With this arrangement, following an output operation, some waiting time is required before input signals can be received and inputs of short duration may not be recognized.

An object of the invention is thus to reduce the number of the circuits using common input and output terminals. A further object of the invention is to provide a circuit which does not respond to a duplicate push so that an instantaneous state is held and to provide a circuit in which a lighting condition presently held is extinguished after which a new lighting condition is maintained. A still further object is to provide a circuit capable of input and output operations in real time.

SUMMARY OF THE INVENTION

In accordance with these and other objects of the invention, there is provided a preset lighting device including input switches and output lighting elements connected to be activated by corresponding ones of the input switches. Each of the input switches and output lighting elements is connected to a corresponding terminal commonly used for input and output. A plurality of latch circuits are provided with the latch circuit being adapted for latching an input applied to a corresponding one of the terminals used for input and output. The latch circuits are connected to corresponding lighting elements. A first gate circuit is provided which is operatively coupled to the common terminals for detecting a state of duplicate switching when more than a single switch is pushed or otherwise activated. A second gate circuit is coupled to the first gate turn on an element corresponding to an input/output terminal to which another input is applied by activation of the corresponding switch.

DESCRIPTION OF THE PREFERRED EMBODIMENTS

Preferred embodiments of the invention will be described in detail with reference to the accompanying drawings.

Figure 1:
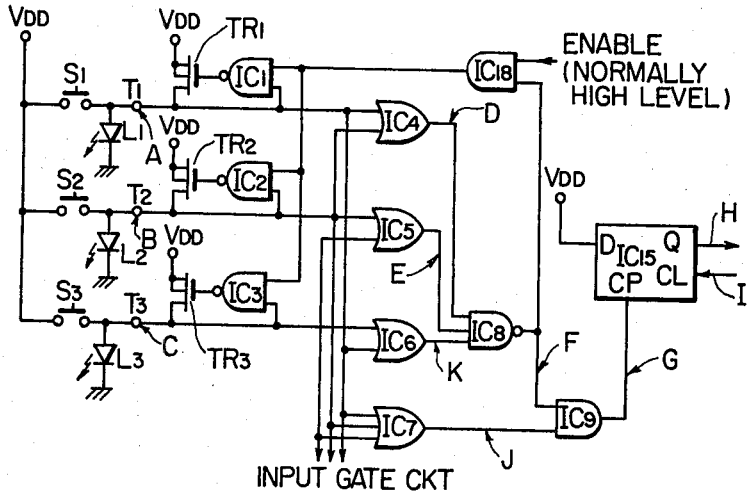
FIG. 1 is a circuit diagram showing a first preferred embodiment of a preset lighting device according to the invention.
Figure 2:
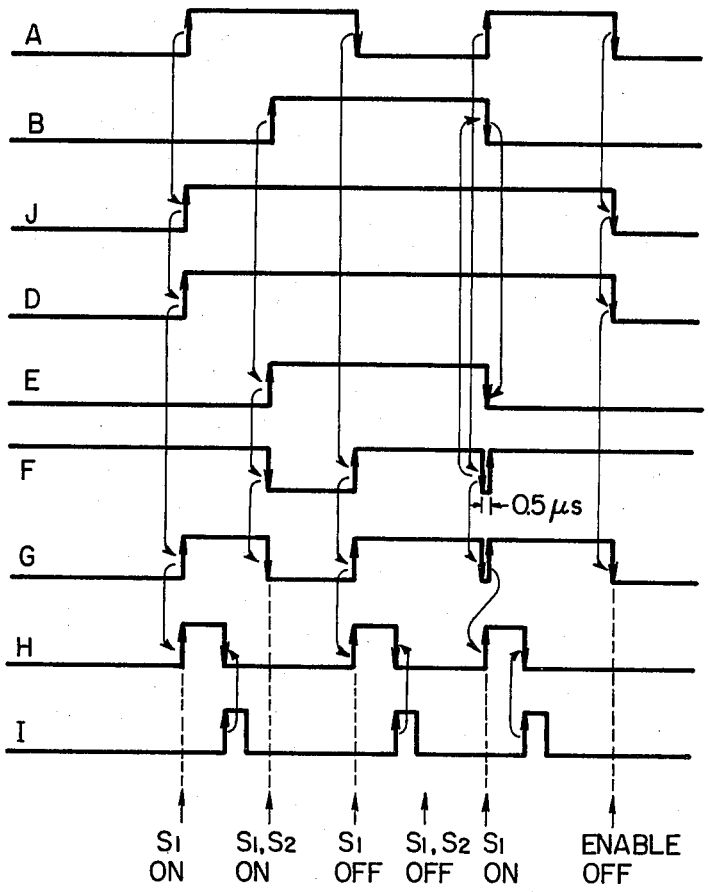
FIG. 2 is a timing chart for a description of the operation of the circuit of FIG. 1.

FIGS. 1 and 2 illustrate embodiments in which three inputs are provided in a preset lighting device. Referring to FIG. 1, switches S1, S2 and S3 are connected between a power source $V_{DD}$ and input/output terminals T1, T2 and T3, respectively. Here, input signals are active in the high state. The input/output terminals T1, T2 and T3 are connected to ground through limiting devices such as light emitting diodes (LEDs) L1, L2 and L3, respectively, and to an OR gate IC7. The input/output terminals are coupled to input circuits. The inputs of each of the OR gates IC4, IC5 and IC6 are connected to two of the three input/output terminals T1, T2 and T3. Specifically, the OR gate IC4 is connected to the input/output terminals T1 and T2 but not T3, the OR gate IC5 is connected to the input/output terminals T2 and T3 but not T1, and the OR gate IC6 is connected to the input/output terminals T1 and T3 but not T2. The outputs of the OR gates IC4, IC5 and IC6 are applied to a NAND gate IC8.

In this circuit, when one of the switches S1, S2 and S3 is pushed, the output signal J of the OR gate IC7 goes high. When all three of the switches are pushed, the outputs D, E and K of the OR gate IC4, IC5 and IC6 go high. The output signal F of the NAND gate IC8 goes low when the outputs of the OR gates IC4, IC5 and IC6 satisfy the logical AND condition. The output of an AND gate IC9 connected both the output signal J of the OR gate IC7 and the output signal F of the NAND gate IC8 is applied to a clock pulse input terminal CP of D type flip-flop IC15. The Q output of the D type flip-flop IC15 is responsive to the data on the D input terminal connected to the power source $V_{DD}$ when a leading edge of a clock pulse is applied.

The input/output terminals T1, T2 and T3 are also connectoutputs of NAND gates IC1, IC2 and IC3, respectively. Each of these transistors and its associated NAND gate constitute a latch circuit.

Referring to FIG. 2 which is a timing chart for the circuit of FIG. 1, when all of the switches S1, S2 and S3 are open, signals D, E, K and J in the circuit are at low levels. The signal G is at a low level because, although the signal F is high, the signal J is low. The changes of levels for each signal are indicated by arrows. "Switch S1 on" indicates the switch S1 is pushed. First, the signal A goes high after which the signals D and J go high. As the signal J remains at a high level, the signal G goes high when the signal goes high. The leading edge of signal G changes the Q output of the D type flip-flop IC15 to high since the D input terminal is connected to the power source $V_{DD}$. A clear pulse applied to CL input approximately 4 μsec after the signal H goes high changes the Q output to low. Therefore, a pulse of approximately 4 μsec duration appears on the signal H. The common terminals of the NAND gates IC1, IC2 and IC3 connected to the signal F through the AND gate IC18 are normally high. When the switch S1 is pushed, the output of the NAND gate IC1 goes low and the P-channel MOS transistor TR1 turns on since the gate goes to low level. Therefore, the latch composed of the transistor TR1 and the NAND gate IC1 is set and the lighting device L1 is maintained in the on condition even after the switch S1 is released.

Next, if the switch S2 is pushed while pushing the switch S1, there is a duplicate switching condition. In this condition, the signal E goes high. Since the signals D and K are high, the signal F goes low at the leading edge of the signal E. The signal G goes low following the signal F. The signal H does not change because the Q output of the D type flip-flop IC15 never changes at the trailing edge of the clock.

If only the switch S1 is released and thus turned off, the signal F goes high since the duplicate condition is released. The signal G is rendered high and the output of the D type flip-flop IC15 is then a 4 μsec duration pulse which is the same state as when the first switch S1 was pushed. That is, when two of the input/output terminals T1, T2 and T3 are turned on, the clock for the D type flip-flop IC15 goes low and the Q output does not change. On the other hand, when a duplicate push is released and it becomes the same state as for a single push, the clock goes high and then the Q output goes high.

When the switches S1, S2 and S3 are pushed one after another, the lighting device L2 connected to the signal B remains on even after the switch S1 is released. When the switch S1 is pushed, the signal F goes low since the signals A and B go high. When the signal F goes low, the NAND gates IC1, IC2 and IC3 are turned off then the lighting device L2 connected to the signal B and the input/output terminal T2, goes off. When it goes off, the only pushed switch is S1. As the signal A is still high, a negative short pulse appears on the signal F. At this time, the signal G operates in the same way so that the leading edge of the pulse renders the Q output of the D type flip-flop IC15 high and a pulse appears on the signal H.

In order to turn off the lighting device, it is required that the enable input be momentarily set to the OFF state or low level. From this state, it is possible to return to the first state on the timing chart. Furthermore, the operations of the remaining circuits are inhibited so long as the enable input remains at a low level. During this condition, the input operation is not carried out.

Figure 3:
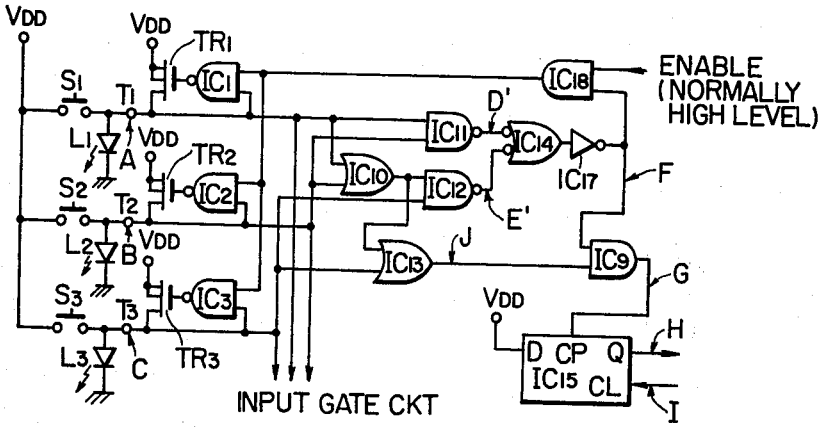
FIG. 3 is a circuit diagram showing a second preferred embodiment of a preset lighting device according to the invention.

Referring to FIG. 3, a circuit of a second embodiment of the invention is shown. In this circuit, a 2-input NAND gate IC11 is connected to the input/output terminals T1 and T2 and also to a 2-input OR gate IC10 whose output is connected to one of the inputs of 2-input NAND gate IC12. The other input is connected to the input/output terminal T3. The inputs of an OR gate IC13 are connected in parallel to two inputs of a NAND gate IC12. That is, the output of the OR gate IC13 is the logical OR output of the input/output terminals T1, T2 and T3. The output of the NAND gate IC12 goes low when the input/output terminal T3 and at least one of input/output terminals T1 and T2 is enabled thereby rendering the output of the NAND gate IC14 high. The NAND gate IC9 and the D type flip-flop are connected in the same manner as shown in FIG. 1.

Figure 4:
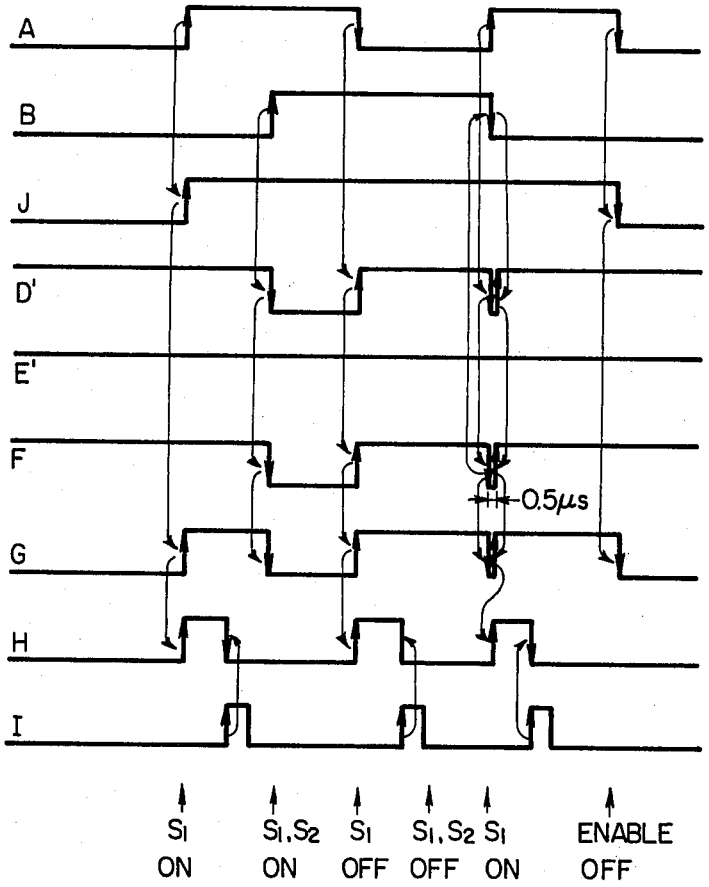
FIG. 4 is a timing chart for a description of the operation of the circuit of FIG. 3.

With reference to the timing chart shown in FIG. 4, the difference between the circuits of FIGS. 1 and 3 is the behavior of the signals D and E. (These are indicated by D' and E' in FIG. 4, respectively.) However, the basis operation of the circuits of FIGS. 1 and 3 is the same.

According to the present invention, in the case of common input/output terminals to which input signals are applied and from which output signals are derived, the input and output operations are not time shared. Accordingly, the input and output operations are quickly implemented in real time. For duplicate switching, no response is produced. Further, the shift of lighting condition is carried out in such a manner that, after a previous lighting condition is released, the following lighting condition appears. Therefore, the circuit of the invention is advantageous in that the previous and the following lighting conditions can be easily confirmed. The circuit according to the invention is particularly useful for a preset input circuit formed with an IC chip where space is limited.

What is claimed is:

1. A preset lighting device comprising: input switches and output lighting elements connected to be activated by corresponding ones of said input switches, each of said input switches and output lighting elements being connected to a corresponding terminal commonly used for input and output; a plurality of latch circuits, one of said latch circuits being provided for latching an input applied to the corresponding one of said terminals, each said latch circuit being connected to a corresponding lighting element; a first gate circuit operatively coupled to said common terminals for detecting a state of duplicate switching when more than a single switch is activated; and a second gate circuit operative to turn off at least a predetermined one of said output lighting elements in response to an output of said first gate circuit indicative of duplicate switching and to turn on an element corresponding to one of said switches which has been activated.

2. The preset lighting device of claim 1 wherein each said latch circuit comprises a NAND gate and a P channel MOS transistor, a gate electrode of said transistor being coupled to an output of said NAND gate and one of a drain and source terminal being coupled to an input terminal of said NAND gate and to the corresponding terminal used for input and output.

3. The preset lighting device of claim 2 further comprising a flip-flop having a clock input coupled to an output of said second gate circuit and a clear input coupled to an external source of the clear pulse.

4. A preset lighting device comprising: a plurality of switches, each of said switches having a first terminal coupled to a voltage source; a plurality of lighting elements, one of said lighting elements having a first terminal coupled to a second terminal of a corresponding one of said switches and a second terminal coupled to ground; a plurality of first NAND gates provided one for each of said switches, each of said NAND gates having a first input coupled to said first terminal of the corresponding lighting element; a plurality of P channel MOS transistors, one of said transistors being provided for each NAND gate, each of said transistors having a gate electrode coupled to an output of the corresponding NAND gate and one of drain and source electrodes coupled to said first terminal of the corresponding lighting element and said first input of the corresponding NAND gate and the other of said drain and source terminals coupled to said power source; a plurality of first OR gates, one of said first OR gates being provided for each NAND gate, each of said first OR gates having a first input coupled to said first input of the corresponding NAND gate and other inputs coupled to other first inputs of other NAND gates except for one NAND gate; a second NAND gate, said second NAND gate having an input coupled to outputs of each of said first OR gates; a second OR gate, said second OR gate having an input coupled to each of said first inputs of each of said first NAND gates; a first AND gate, said first AND gate having a first input coupled to an output of said second NAND gate and a second input coupled to an output of said second OR gate; a flip-flop having a clock input coupled to an output of said first AND gate; and a second AND gate, said second AND gate having a first input coupled to said output of said second NAND gate and a second input coupled to a source of a normally-high enable signal and an output coupled to second inputs of each of said first NAND gates.

5. A preset lighting device comprising: a plurality of switches, each of said switches having a first terminal coupled to a voltage source; a plurality of lighting elements, one of said lighting elements having a first terminal coupled to a second terminal of a corresponding one of said switches and a second terminal coupled to ground; a plurality of first NAND gates provided one for each of said switches, each of said NAND gates having a first input coupled to said first terminal of the corresponding lighting element; a plurality of P channel MOS transistors, one of said transistors being provided for each NAND gate, each of said transistors having a gate electrode coupled to an output of the corresponding NAND gate and one of drain and source electrodes coupled to said first terminal of the corresponding lighting element and said first input of the corresponding NAND gate and the other of said drain and source terminals coupled to said power source; a first OR gate having a first input coupled to said first input of a first of said first NAND gates and a second input coupled to said first input of a second one of said NAND gates; a second OR gate, said OR gate having a first input coupled to said first input of a third one of said first NAND gates and a second input coupled to an output of said first OR gate; a second NAND gate, said second NAND gate having a first input coupled to said first input of said first OR gate and a second input coupled to said second input of said first OR gate; a third NAND gate, said third NAND gate having a first input coupled to said output of said first OR gate and a second input coupled to said first input of said third one of said first NAND gates; a fourth NAND gate, said fourth NAND gate having a first input coupled to an output of said second NAND gate and a second input coupled to an output of said third NAND gate; an inverter having an input coupled to an output of said fourth NAND gate; a first AND gate, said first AND gate having a first input coupled to an output of said inverter and a second input coupled to an output of said second OR gate; a flip-flop having a clock input coupled to an output of said first AND gate; and a second AND gate having a first input coupled to said output of said inverter and a second input coupled to a source of a normally-high enable signal and an output coupled to second inputs of each of said first NAND gates.

* * * * *